US005308151A

United States Patent [19]

Sugden et al.

[11] Patent Number: 5,308,151

[45] Date of Patent: May 3, 1994

[54] CUTTER WHEEL ASSEMBLY FOR MINING MACHINE

[75] Inventors: David B. Sugden, Tasmania, Australia; John Turner, Renton, Wash.

[73] Assignee: Z C Mines Pty Ltd., New South Wales, Australia

[21] Appl. No.: 980,251

[22] Filed: Nov. 23, 1992

Related U.S. Application Data

[62] Division of Ser. No. 701,503, May 16, 1991, Pat. No. 5,205,612.

[30] Foreign Application Priority Data

May 17, 1990 [AU] Australia ..... PK 0197

[51] Int. Cl.[5] ..... E21B 10/12; E21C 25/10

[52] U.S. Cl. ..... 299/86; 37/189

[58] Field of Search ..... 299/73, 85, 86, 88, 299/89; 175/91, 355, 364, 373; 37/189, 190

[56] References Cited

U.S. PATENT DOCUMENTS

| | | | |
|---|---|---|---|
| 3,282,367 | 11/1966 | Mathew et al. | 180/235 |
| 3,439,937 | 4/1969 | Dixon | 280/446 |
| 3,662,848 | 5/1972 | Magnusson | 180/235 |
| 3,929,378 | 12/1975 | Frenyo et al. | 299/64 |
| 4,035,024 | 7/1977 | Fink | 299/86 X |
| 4,312,541 | 1/1982 | Spurgeon | 299/10 |
| 4,548,442 | 10/1985 | Sugden et al. | 299/73 X |
| 5,035,071 | 7/1991 | Stotzer et al. | 299/86 X |

FOREIGN PATENT DOCUMENTS

| | | | |
|---|---|---|---|
| 669287 | 4/1952 | United Kingdom | 299/86 |

OTHER PUBLICATIONS

Handbook of Mining and Tunnelling Machinery by Barbara Stack (1982), pp. 275–277, relating to Krupp Tunneling Machine Model KTF340.

Continuous Surface Mining, from the Proceedings of International Symposium Edmonton Sep. 29–Oct. 1, 1986, Trans Tech Publications, 1987, pp. 211 and 213, relating to the Krupp SchRs 650/5/28 BWE Excavator and 700 I BWE Excavator.

*Primary Examiner*—David J. Bagnell

*Attorney, Agent, or Firm*—Graybeal Jackson Haley & Johnson

[57] ABSTRACT

Mining apparatus is disclosed in which a cutting wheel supporting a plurality of roller-cutters rotates about a horizontal axis and is supported on a slewing boom for cutting a tunnel with a flat floor and roof and elliptical walls as it slews across a mining face. The slewing boom is supported on a main beam assembly, the front end of which rests on powered crawler tracks and the rear end of which passes through a gripper assembly which may be clamped between the floor and roof of the tunnel, and against which the main beam assembly may be urged forward for engaging the roller-cutters with the mining face. A preload crawler is urged against the roof of the tunnel above the powered crawler tracks to locate the main beam assembly rigidly relative to the tunnel such that the roller-cutters may cut the rock in the mining face with minimal loss of cutting force due to vibration.

10 Claims, 5 Drawing Sheets

CUTTER WHEEL ASSEMBLY FOR MINING MACHINE

This application is a division of application Ser. No. 07/701,503, filed May 16, 1991, now U.S. Pat. No. 5,205,612.

BACKGROUND OF THE INVENTION

This invention relates to transport apparatus.

This invention has particular but not exclusive application to excavating apparatus, and for illustrative purposes reference will be made to such application. However, it is to be understood that the transport apparatus of this invention could be used in other applications, such as cross-country transport.

A continuous mining machine typically comprises a mining head supported by a head transport apparatus which guides the mining head in a desired direction of excavation and provides the stabilizing forces necessary to resist the cutting forces applied at the mining head, as the latter must of necessity overhang the front of the transport apparatus.

Where the cutting forces are relatively light, such as in the mining of soft materials like coal, the transport apparatus may include a pair of crawler tracks, and the dead weight of the transport may be sufficient to prevent it from overbalancing. Where the cutting forces are relatively high, such as in the mining of hard rock, it becomes necessary to provide further stabilization for the transport apparatus, such as may be obtained by clamping it against the walls of the tunnel being cut.

DISCUSSION OF THE PRIOR ART

Continuous mining machines intended for the cutting of hard rock have been developed over a number of years. A number of these have utilized the principle of cutting with cutters disposed about a cutting wheel rotated about a transverse axis and slewed transversely about a vertical axis to form a tunnel with a flat floor and roof and curved side walls. Seberg (U.S. Pat. No. 976,703) discloses such a cutting wheel supported on a pair of spaced supporting trucks, while App (U.S. Pat. No. 1,290,479) utilizes a chain-driven cutting wheel supported on a rail-mounted carriage. Auger-type cutters supported on a crawler-undercarriage form the basis of the mining machine disclosed by Bredthauer (U.S. Pat. No. 3,290,095). Fink (U.S. Pat. No. 4,035,024) utilized roller-type cutters mounted on the periphery of a horizontal cutting wheel to cut a shallow trench in hard rock. While such roller-cutters are more effective and longer-lasting than picks in cutting hard rock, the cutting wheels could not slew, and the carriage supporting the wheels advanced against a support frame clamped to the walls of the trench.

Sugden, et al (U.S. Pat. No. 4,548,442) discloses a mining machine utilizing a cutting wheel rotatable about a horizontal axis and supporting a plurality of roller-cutters around its periphery. The cutting wheel is supported by a slewable boom, permitting the cutting wheel to excavate a tunnel with a flat floor and roof and elliptical side walls. The slewable boom is supported on a carriage which may slide longitudinally relative to an undercarriage to urge the cutting wheel into the advancing face of the tunnel. The undercarriage includes crawler tracks for accommodating advancing of the complete machine, and upper and lower jacks for clamping the undercarriage between the tunnel roof and floor.

In practice, this arrangement produced a workable mining machine, but the flexibility of the structure supporting the cutting wheel resulted in high levels of vibration between the roller-cutters and the mining face, reducing the effectiveness of the cutting process. In addition, the rolling cutters were distributed over a plurality of cutting planes, emulating to some degree the spaced relationship employed on tunnel boring machines, in which application rolling cutters were first utilized. Such a cutter distribution is wasteful when applied to a slewing cutting wheel however, as only cutters in the leading plane perform useful work when the cutting wheel slews across an excavation face.

SUMMARY OF THE INVENTION

The present invention aims to alleviate the above disadvantages and to provide excavating apparatus which will be reliable and efficient in use. Other objects and advantages of this invention will hereinafter become apparent.

With the foregoing and other objects in view, this invention in one aspect resides broadly in a mobile mining machine suitable for cutting a tunnel in rock, said mobile mining machine including:

an elongate main beam assembly supported at longitudinally spaced locations by first beam support means and second beam support means, said first beam support means including a travel assembly adapted for relatively free longitudinal movement along the floor of the tunnel and said second beam support means including clamping means which may be selectively clamped to the walls of said tunnel;

a boom pivot adjacent said first beam support and having a substantially vertical pivot axis substantially perpendicular to the longitudinal axis of said main beam assembly;

a boom assembly attached to said boom pivot for pivotal movement thereabout;

slewing means extending between said boom assembly and said main beam assembly for controlling pivotal movement of said boom assembly about said boom pivot;

a cutting wheel assembly supported at the free end portion of said boom assembly, said cutting wheel assembly having an axis of rotation substantially co-planar with said longitudinal axis and substantially perpendicular to said boom pivot axis and having a plurality of roller-cutter assemblies mounted about its periphery;

drive means for rotating said cutting wheel assembly, and advancing means for longitudinally advancing said main beam assembly relative to said second beam support means. The clamping means may be selectively clamped to the vertical or horizontal walls of the tunnel.

Preferably, the travel assembly includes a transversely-spaced pair of crawler tracks joined to the main beam assembly through transverse crawler pivots such that the main beam may tilt within a longitudinal vertical plane about said crawler pivots for alterations to the vertical alignment of the cutting wheel. The travel assembly may also include substantially vertical steering pivots whereby the crawlers, wheels or the like may be steered relative to the main beam assembly for enhanced maneuverability of the mining machine. Of course, if desired, the travel assembly may include road wheels or rollers, or track wheels running on tracks laid along the tunnel floor. The travel assembly may also include travel drive means operable to assist advancing said cutting wheel against the advancing face of the tunnel.

The clamping means may include horizontal actuators for moving the adjacent portion of said main beam transversely relative to the tunnel and vertical actuators for moving the adjacent portion of said main beam vertically relative to the tunnel, whereby control may be exercised over the horizontal and vertical alignment of the tunnel being cut by altering the alignment of the cutting wheel relative to the travel assembly.

A preloading assembly may be provided, and may be attached to the main beam assembly for selective engagement with the roof of the tunnel such that the location of the boom pivot may be held relative to the tunnel against disturbing forces in excess of those which may be resisted by the weight of the mining machine alone. The preloading assembly may include an actuator adapted for applying a predetermined level of force to the tunnel roof, and may include a crawler assembly, a wheel, a roller or a slide assembly such that the main beam may advance along the tunnel while maintaining the desired level of preload.

The mobile mining assembly may further include a rear auxiliary assembly comprising a rear frame supported on a rear travel assembly and attached to the rear portion of the main beam assembly through a rear pivot such that the mining machine may be relocated by travel on the travel assembly and the rear auxiliary assembly with the clamping frame detached from the tunnel walls. Suitably the rear pivot includes a ball or universal joint such that the main beam assembly and the rear auxiliary may articulate relative to one another and a substantially vertical-axis steering slide such that unevenness in the tunnel floor may be accommodated. Steering means may be associated with the vertical steering slide such that pivoting of the rear auxiliary assembly relative to the main beam may be achieved for steering purposes.

In a further aspect of this invention, a transport assembly is disclosed, comprising:

an elongate main beam assembly supported at longitudinally spaced locations by first beam support means and second beam support means, said first beam support including a travel assembly adapted for relatively free longitudinal movement and said second beam support includes a rear travel assembly attached to the rear portion of said main beam assembly through a rear pivot. The rear pivot may include a ball joint supporting a vertical steering slide, and steering means for rotating the rear travel assembly about the ball joint relative to the main beam assembly such that steering of the transport assembly may be accomplished. Preferably, the travel assembly includes a pair of transversely-spaced crawler tracks for movement over uneven ground, and the rear travel assembly may also include crawler tracks if desired.

In a further aspect, this invention resides in a cutter wheel assembly including a cutting wheel having a peripheral wheel rim supporting a plurality of main wheel cutters having cutting rims disposed substantially within a single cutting plane, and vertical to the cutter wheel axis. Preferably a plurality of gauge wheel cutters are disposed on either side of the plane of the cutting rims and the gauge axes about which said gauge wheels rotate are substantially inclined to said main cutting plane. In this way, a substantially continuous cut may be achieved on an excavation face by the operation of successive cutters as the cutting wheel rotates. This minimizes power demand relative to excavated volume, or cutting efficiency, as the spacing of successive cuts formed across a mining face may be controlled to its maximum possible value for the prevailing conditions, minimizing the degree of rock crushing required for excavation. The cutting efficiency may be further enhanced by arranging the main wheel cutters and the gauge wheel cutters such that the proportion of the width of the cut excavated by the gauge cutters is minimized, since their cutting efficiency is low relative to that of the main wheel cutters. In particular, the gauge wheel cutters should be mounted as close as possible along the axis to the main cutting plane, consistent with producing a cut which will provide the necessary clearance for the wheel rim and other rotating components, as well as for the relevant boom-mounted components such as the cutting wheel drive means. Thus it is important that the wheel rim be as narrow as possible to minimize the clearance cut which needs to be excavated by the gauge cutters. In a preferred embodiment, the wheel rim is enclosed between a pair of opposed cones having a common base circle joining the portions of the cutting rims furthest from the cutting wheel axis in which the included angles at the apexes of the cones are maximized, and are at least one hundred and twenty degrees. In order to minimize the proportion of the excavating carried out by the gauge wheel cutters, the spacing between a pair of planes perpendicular to the cutter wheel axis and enclosing the cutting portions of the gauge wheel cutters should not exceed one-sixth, and preferably be less than one-tenth, of the diameter of the common base circle.

The gauge wheel cutters may be arranged for cutting at a smaller radius relative to the cutting wheel axis than the primary cutters such that the gauge cutters may engage with the mining face only at the extremities of the slewing travel of the cutting wheel while rotating clear of the excavation face formed by the main wheel cutters. Suitably, the inclination between said cutting wheel axis and said gauge axes is greater than twenty-five degrees.

Preferably, the cutting wheel is supported on a boom assembly for slewing motion about a slewing pivot axis, the slewing pivot axis being substantially perpendicular to the cutter wheel axis and coplanar with the cutting plane such that cutting forces produce minimal torque reaction about the slewing pivot axis.

The cutting wheel body is suitably formed to include a hub portion joined to a circumferential rim only by a pair of spaced frusto-conical web portions. The thickness of the web portions is set to a level adequate to withstand transverse (axial) forces applied to the cutting wheel such that transverse stiffeners are not needed. This simplifies the construction of the cutting wheel and minimizes the extent of regions of stress concentration typically associated with stiffeners.

In another aspect this invention provides a method of cutting a tunnel, including:

providing a mobile mining machine comprising an elongate main beam assembly supported at a pair of spaced longitudinal locations by a travel assembly adapted for relatively free longitudinal movement along the floor of a tunnel and a clamping frame which may be selectively clamped to the wells of said tunnel and selectively moved along said main beam, said beam assembly supporting at its front end adjacent said first beam support a boom pivot, the boom pivot axis being substantially perpendicular to the longitudinal axis of said main beam assembly, a boom assembly attached to said boom pivot for rotational movement thereabout and supporting at its free end portion a wheel pivot, the wheel pivot axis being substantially co-planar with said longitudinal axis and substantially perpendicular to said boom pivot axis, slewing means attached between said boom assembly and said main beam for controlling rotational movement of said boom assembly about said boom pivot, a cutting wheel assembly mounted to said wheel pivot for rotation thereabout and having a plurality of roller-cutter assemblies mounted about its periphery, and wheel drive means for rotating said cutting wheel assembly;

energizing said clamping means to force said clamping assembly into frictional engagement with the tunnel walls;

energizing said advancing means to force said main beam forward along the tunnel relative to said clamping means;

energizing said slewing means to sweep said cutting wheel assembly across the advancing face of the tunnel;

energizing said wheel drive means to rotate said roller-cutter assemblies about said wheel pivot axis;

de-energizing said clamping means to release said clamping assembly from the tunnel walls;

energizing said advancing means in reverse function to draw said clamping assembly forward relative to said main beam and the tunnel.

In another aspect this invention includes a method of forming a mobile mining machine, including:

providing an elongate main beam assembly supported at a pair of spaced longitudinal locations by a travel assembly adapted for relatively free longitudinal movement along the floor of a tunnel and clamping means which may be selectively clamped to the walls of said tunnel and selectively moved longitudinally relative to said main beam by advancing means, said main beam assembly supporting at its front end adjacent said first beam support a boom pivot, the boom axis of rotation of said boom pivot being substantially perpendicular to the longitudinal axis of said main beam assembly;

providing a boom assembly attached to said boom pivot for rotational movement thereabout, said boom assembly supporting at its free end portion a wheel pivot, the wheel axis of rotation of said wheel pivot being substantially co-planar with said longitudinal axis and substantially perpendicular to said boom pivot axis;

providing slewing means attached between said boom assembly and said main beam assembly for controlling rotational movement of said boom assembly about said boom pivot;

providing a cutting wheel assembly mounted to said wheel pivot for rotation thereabout and having a plurality of roller-cutter assemblies mounted about its periphery;

providing wheel drive means for rotating said cutting wheel assembly; and assembling said main beam assembly, said boom assembly, said slewing means, said cutting wheel assembly and said wheel drive means to form said mobile mining machine.

In a further aspect, this invention resides in a method of controlling a mobile mining machine of the type having a cutting wheel rotatable about a horizontal axis by wheel drive means and traversable across a mining face in order to maximize its mined output consistent with maintaining cutter wheel power below a desired limit, including selectively controlling the kerf depth and kerf spacing such that the kerf ratio of kerf depth to kerf spacing approaches the optimum value for the rock being cut by continuously monitoring the wheel drive means power input and altering the speed of the slewing means to vary the traversing speed and thus the kerf spacing to maintain said power input close to a predetermined level. The method may further include the monitoring of changes in rock properties transversely across a rock face by storing kerf-spacing information for a traverse of said cutting wheel and utilizing said kerf-spacing information to control the kerf spacing or the kerf depth during successive traverses.

Force-measurement transducers may be provided for monitoring selected forces applied to the cutting wheel by the cutting process, and the output from the force-measurement transducers may be applied to the feedback control system for reducing the speed of the slewing means as required to maintain the selected forces below pre-determined limits such that the method of control may not result in the application of undesirable levels of force to the mining machine.

The gripper assembly may include traverse means for moving the portion of the beam member engaged therewith, whereby the excavation head may be steered vertically and/or horizontally as desired for excavating a tunnel of a desired curvature.

An auxiliary transport assembly may be attached to the free end portion of the beam member by connection means and may be powered for urging the excavation apparatus forward or rearward as desired, such as when moving the excavation apparatus to or from an excavation site. Suitably, the connection means includes a ball joint in series with a vertical slide such that the inclination of the beam member in the vertical plane may be controlled by interaction with the gripper assembly while permitting the second transport assembly to align itself independently with the floor of the tunnel.

In another aspect, this invention resides in a method of forming an excavating apparatus, including:

providing an excavating head for excavating material from an excavating face;

providing a transport assembly adapted for supporting said excavating head for movement towards the excavated face;

providing biasing means for biasing said excavating head into engagement with the excavated face;

providing traversing means for moving said excavating head across the excavated face such that material may be excavated progressively from selected portions of the excavated face, and assembling said excavating head; said transport assembly, said biasing means and said traversing means to form said excavating apparatus.

DESCRIPTION OF THE PREFERRED EMBODIMENT

In order that this invention may be more easily understood and put into practical effect, reference will now be made to the accompanying drawings which illustrate a preferred embodiment of the invention, wherein:

FIG. 5 is a cross-sectional view of the gripper assembly of the mining apparatus;

Figure 1:
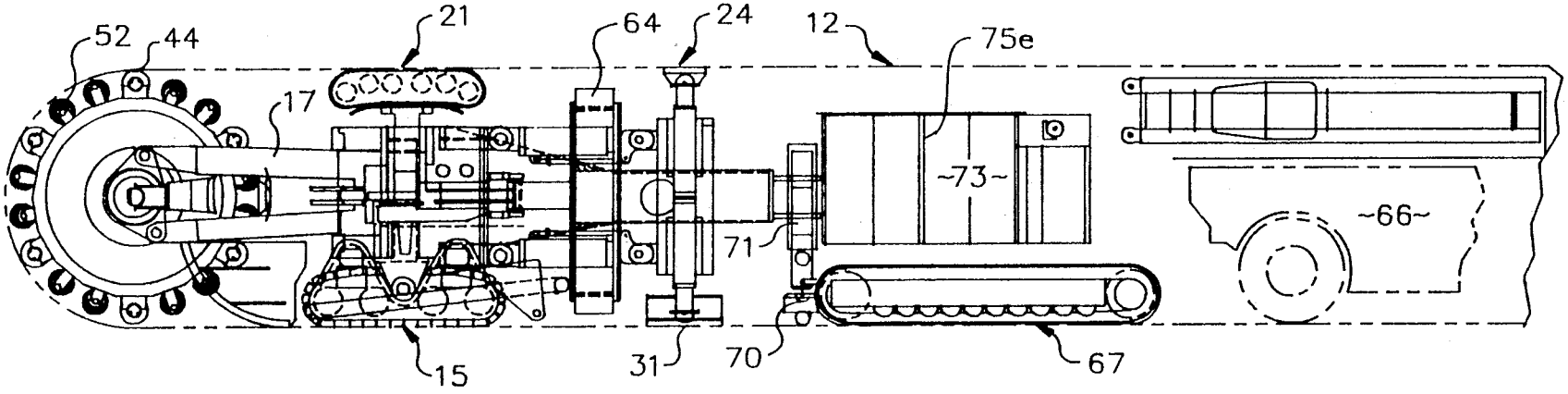
FIG. 1 is a side view of a mobile mining apparatus according to the invention.
Figure 2:
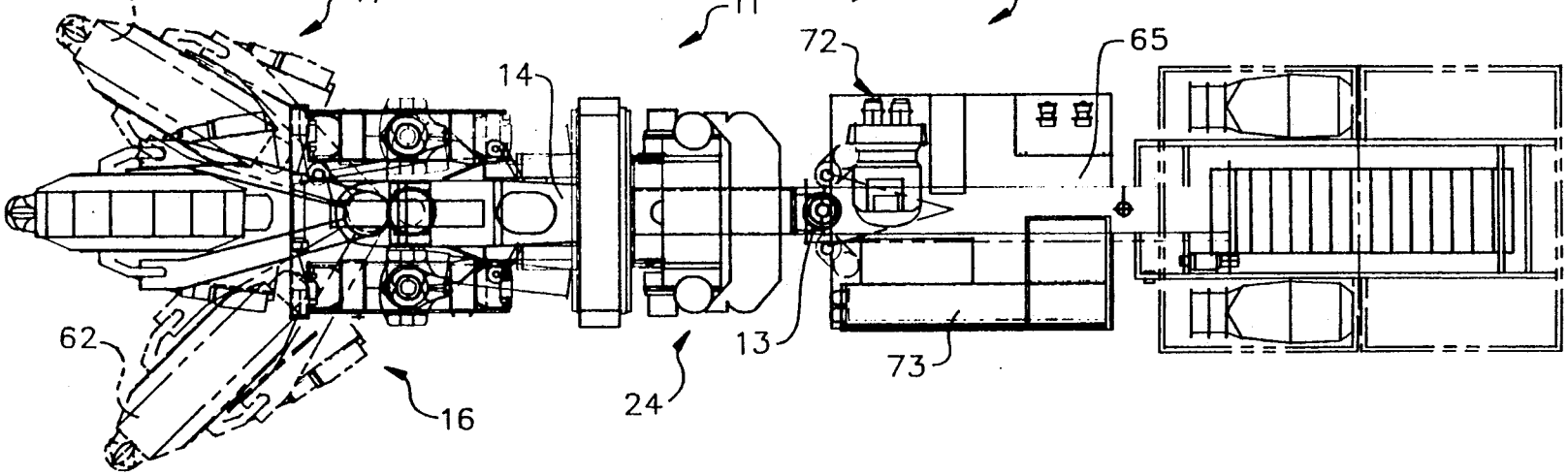
FIG. 2 is a top view of the mobile mining apparatus shown in FIG. 1.
Figure 3:
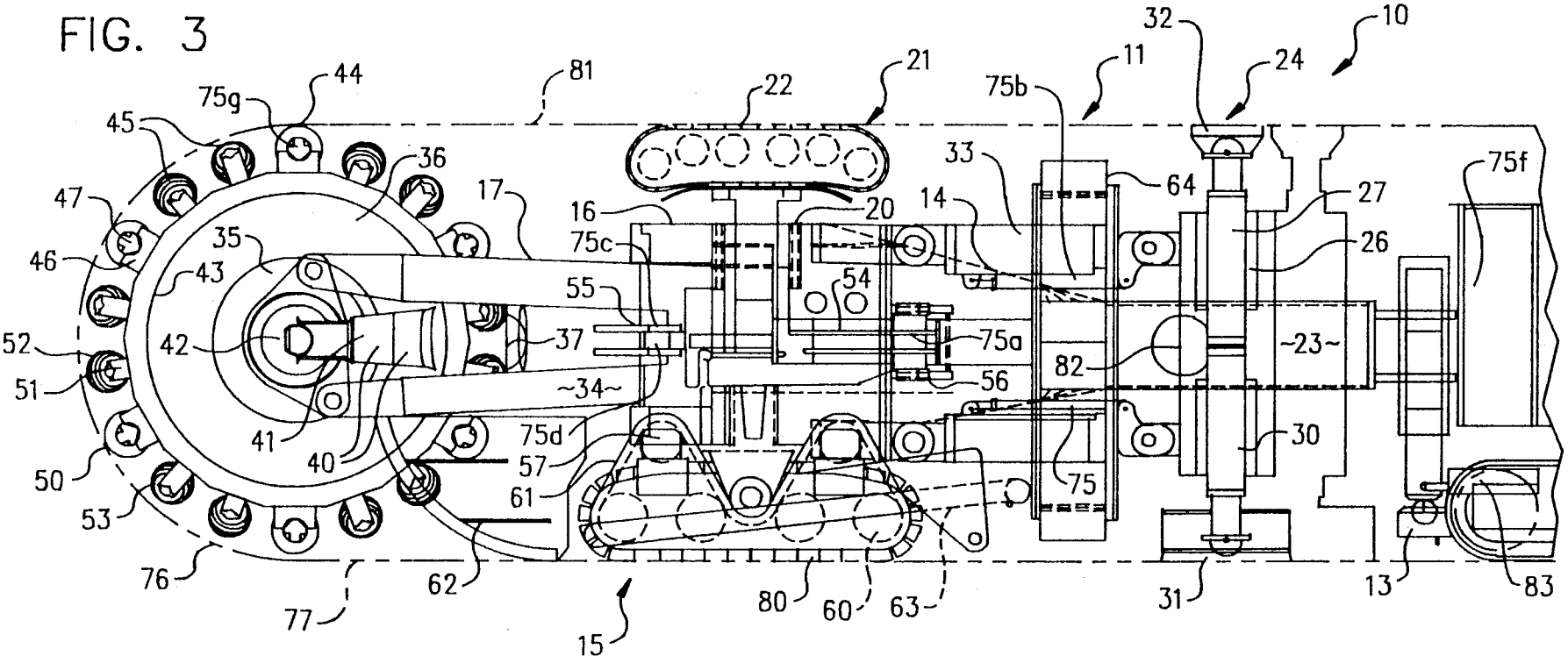
FIG. 3 is a partial side view of the mobile mining apparatus.
Figure 4:
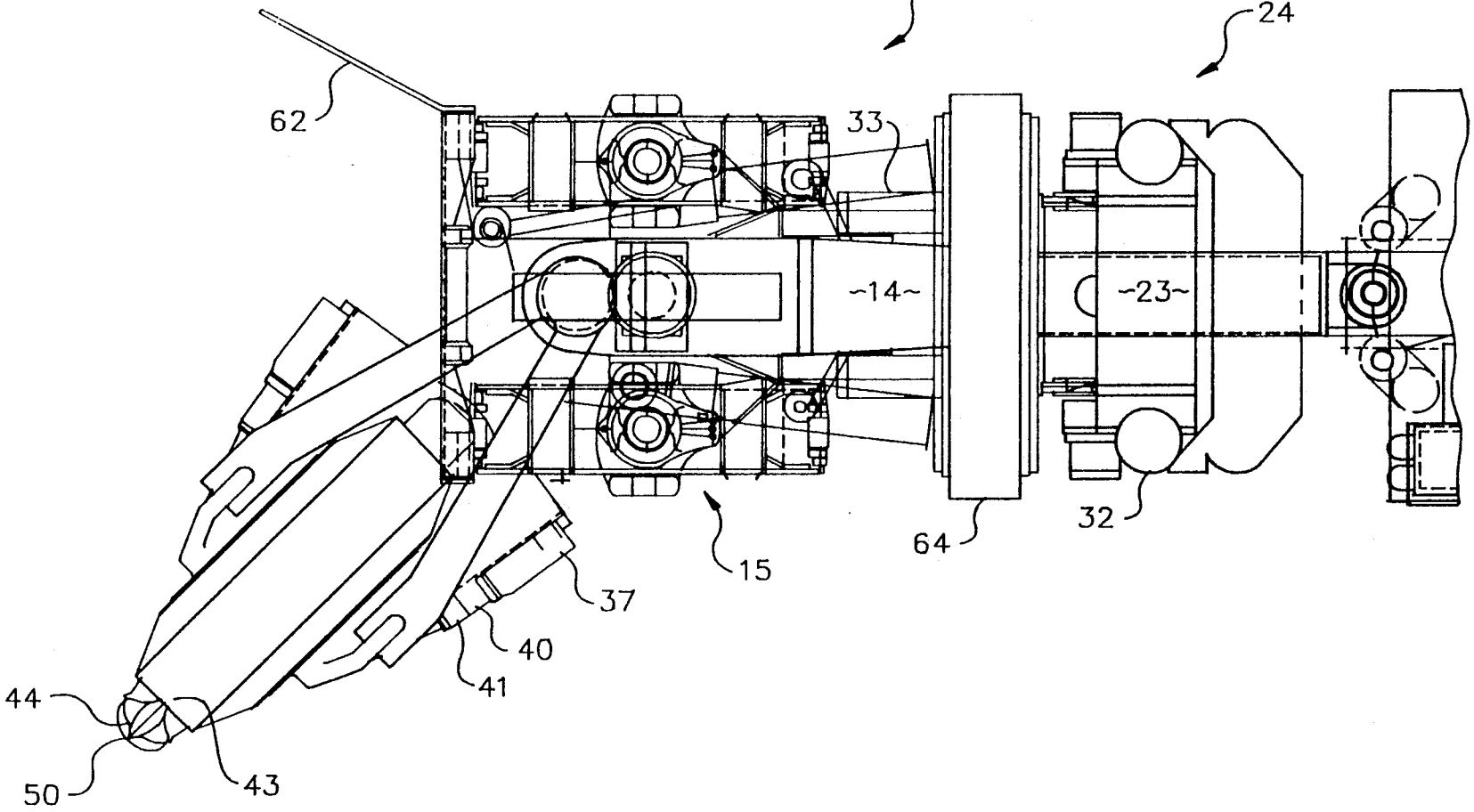
FIG. 4 is a partial top view of the mobile mining apparatus.

The mobile mining apparatus 10 shown in FIGS. 1, 2, 3 and 4 comprises a front travel assembly 11 and a rear travel assembly 12 joined at a coupling 13. The front travel assembly 11 is constructed around a main beam assembly 14 which is supported at its front end on crawler assemblies 15. The front portion of the main beam assembly 14 includes a vertical-axis boom pivot 16 to which a boom assembly 17 is pivoted for traversing motion from side to side. Directly behind the upper portion of the vertical boom pivot 16, a vertical preload cylinder 20 is formed in the main beam assembly 14 and supports a preload assembly 21 including a preload crawler 22.

The main beam assembly 14 terminates rearwardly in a longitudinal guide tube 23, to the free end of which the coupling 13 is attached. A gripper assembly 24 is mounted slidably about the guide tube 23, and a two-axis gimballed yoke assembly 25 mounted to the gripper assembly 24 slides on the guide tube 23. The gripper assembly 24 has a gripper body 26 to the sides of which opposed pairs of upper gripper cylinders 27 and lower gripper cylinders 30 are attached. The free ends of the latter are joined to the outer ends of a floor gripper 31, while the upper gripper cylinders 27 terminate at their free ends in individual roof grippers 32. The gripper body 26 is coupled to the main beam assembly 14 via substantially horizontal plunge cylinders 33.

The boom assembly 17 comprises a boom 34 supporting a planetary reduction gearbox assembly 35 about which a cutting wheel 36 revolves, the gearbox assembly 35 being driven by two cutting wheel drive motors 37 through fluid couplings 40, clutches 41 and bevel input drives 42. The rim 43 of the cutting wheel 36 supports a ring of roller cutter assemblies 44 all disposed substantially in a plane normal to the cutting wheel axis, and outer rings of gauge cutter assemblies 45. Each roller cutter assembly 44 comprises a roller trunnion 46 within which a roller 47 including a central cutting flange 50 may rotate about an axis parallel to the cutting wheel axis. All of the roller cutter assemblies 44 are mounted with their cutting flanges 50 within a common plane perpendicular to the cutting wheel axis. Gauge cutter assemblies 45 comprise gauge trunnions 51 within each of which a gauge roller 52 studded with high-hardness "buttons" 53 may rotate about a gauge axis disposed at a substantial angle to the cutting wheel axis. If desired, the gauge cutters may utilize disc cutters similar to the roller cutter assemblies 44.

The rim 43 and other rotating components are fully enclosed within a pair of cones 92 which share a base circle 93 joining the portions of the cutting flanges 50 which are furthest from the cutting wheel axis, and have included angles at their apexes which are greater than one hundred and twenty degrees, minimizing the clearance necessary outside the portion of the face 76 which is cut by the cutting flanges 50. The gauge cutters 45 are contained between a pair of planes 94 which are perpendicular to the cutting wheel axis and are spaced apart by a distance which is less than one-tenth of the diameter of the base circle 93. These proportions provide adequate clearance for the operation of a cutting wheel 36 of the proportions defined by the cones 92, while minimizing the excavation which must be performed by the gauge cutters.

Swing cylinders 54 are connected between boom lugs 55 formed on the sides of the boom 34 and beam lugs 56 formed on the main beam assembly 14 for rotating the boom assembly 17 about the vertical pivot 16. Crawler drive motors 57 are attached to the frames of the crawler assemblies 15 and drive the crawler idlers 60 through drive chains 61. Scraper plates 62 attached to the main beam 14 and shaped to fit the tunnel bored by the mining apparatus 10 confine cut rock to the region ahead of the crawler assemblies 15. A primary conveyor 63 transports cut rock from ahead of the scraper plates 62 into the lower portion of a carousel conveyor 64 which discharges it onto a secondary conveyor 65 running above the main beam assembly 14 to the rear of the mining apparatus 10 where it may be discharged into a bulk transport vehicle 66.

The rear travel assembly 12 is supported on rear crawlers 67, and the coupling 13 includes a ball joint 70 permitting articulation in both horizontal and vertical directions, and a vertical slide-pivot 71, permitting the rear travel assembly 12 to move up or down independently of the motion of the main beam assembly 14, and to pivot transversely relative thereto. The crawler assemblies 15 and 67 may include transverse gripper treads for enhancing the traction when driven, but it is preferred that they include plain crawlers, and that the desired traction be attained as a result of generating a desired level of preload on the crawler.

The rear travel assembly 12 carries hydraulic pumps 72 for operating the hydraulic cylinders and electrical control cubicles 73 for controlling the operation of electric equipment including the cutting wheel drive motors 37. The control cubicles 73 also house a programmable logic controller (PLC) for controlling the overall operation of the mining apparatus 10.

Swing cylinder length transducers **75*a* are attached to the swing cylinders 54 and are wired to the PLC 74 to allow the transverse horizontal inclination of the boom assembly 17 relative to the main beam 14 to be monitored. Cylinder length transducers 75*a* (boom swing cylinder position transducers) are preferably Temposonics linear displacement transducers manufactured by Temposonics, Research of Triangle Park, N.C. Additional transducers include beam propel cylinder position transducers 75*b*, which measure cylinder extension (which relates directly to beam position). Beam propel cylinder position transducers 75*b* are also preferably Temposonics linear displacement transducers, described above. Also, boom pivot pin strain gauge 75*c*, which measures boom force, may be employed. Boom pivot pin strain gauge 75*c* is preferably a Series 125 strain gauge manufactured by Micro-measurements of Raleigh, N.C. Boom swing cylinder pin strain gauge 75*d* measures swing cylinder force, and is preferably a Micro-measurements Series 125 strain gauge discussed above. Boom swing pressure transducer 75*e* measures the swing system hydraulic pressure and is preferably a model 811 FMG transducer manufactured by Sensotec of Columbus, Ohio. Cutterhead drive motor current sensor 75*f*** measures cutterhead motor current, which relates to power, and is preferably model CT5-005E manufactured by Ohio Semitronics, Inc. of Columbus, Ohio.

To excavate a face 76 at the end of a tunnel 77, the cutting wheel 36 is rotated by the cutting wheel drive motors 37, and the gripper assembly is clamped rigidly between the floor 80 and the roof 81 of the tunnel 77 by extending the gripper cylinders 27 and 30. The cutting flanges 50 of the roller cutter assemblies 44 are urged into engagement with the face 76 to be excavated by extending the plunge cylinders 33. The swing cylinders 54 are then operated to traverse the boom assembly 17 about the boom pivot 16, and the cutting flanges 50 of the rollers 47 score cutter path lines in the face 76, and, provided that the cutter path lines are deep enough relative to their spacing, the material between adjacent cuts will break away from the face 76. As the boom assembly 17 traverses to the desired extent of tunnel width on one side, the gauge cutter assemblies 45 engage with the face 76, forming the edge of the tunnel. The plunge cylinders 33 are extended to advance the rollers 47 into the face 76, the traversing direction of the boom 17 is then reversed, and the excavation process continues, extending the tunnel 77. The length by which the plunge cylinders 33 are extended each cycle is controlled to a pre-determined value by the PLC 74 using length information fed to it from the beam propel cylinder position transducers **75*b*, and the cutterhead motor current from cutterhead motor current transducer 75*f***.

When it is desired to alter the vertical direction in which the mobile mining apparatus 10 is excavating along the tunnel 77, the upper and lower gripper cylinders 27 and 30 are selectively actuated to move the gripper body 26 relative to the tunnel 77. This tilts the main beam assembly 14 through the interaction of the yoke assembly 25 and the guide tube 23. When it is desired to alter the transverse direction in which mining is to occur, the transverse yoke cylinders 82 are selectively activated to move the guide tube 23 transversely relative to the tunnel 77, rotating the main beam assembly about a vertical axis. The mobile mining apparatus 10 may be steered while being moved to a further mining location along a tunnel by retracting the gripper cylinders 27 and 30 to free the gripper assembly from the floor 80 and roof 81, and utilizing steering means 83 to vary the steering angle formed between the main beam assembly 14 and the rear travel assembly 12 at the vertical slide-pivot 71.

Figure 6:
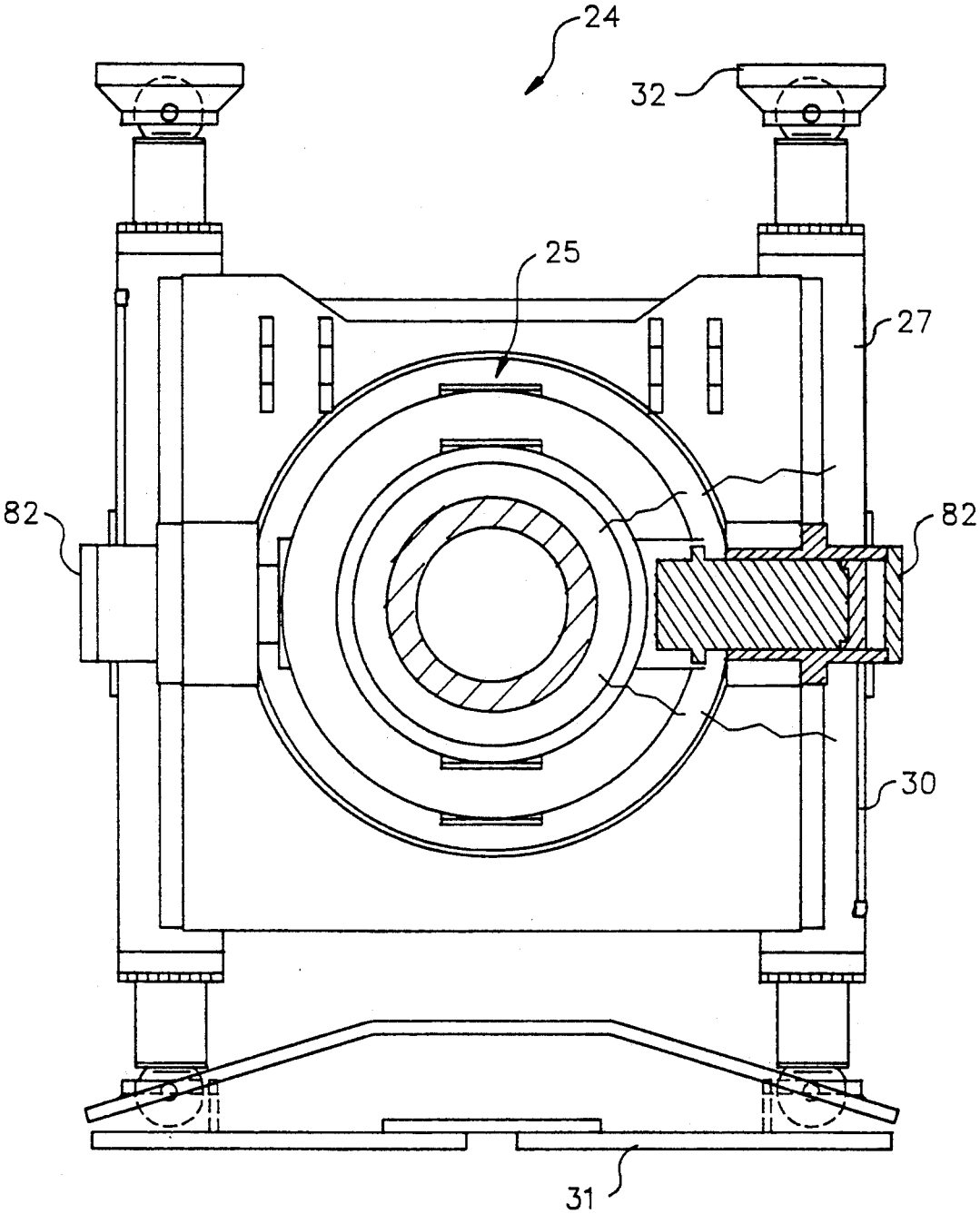
FIG. 6 is a block diagram of the apparatus for optimizing pitch and swing typifying the present invention.
Figure 6:
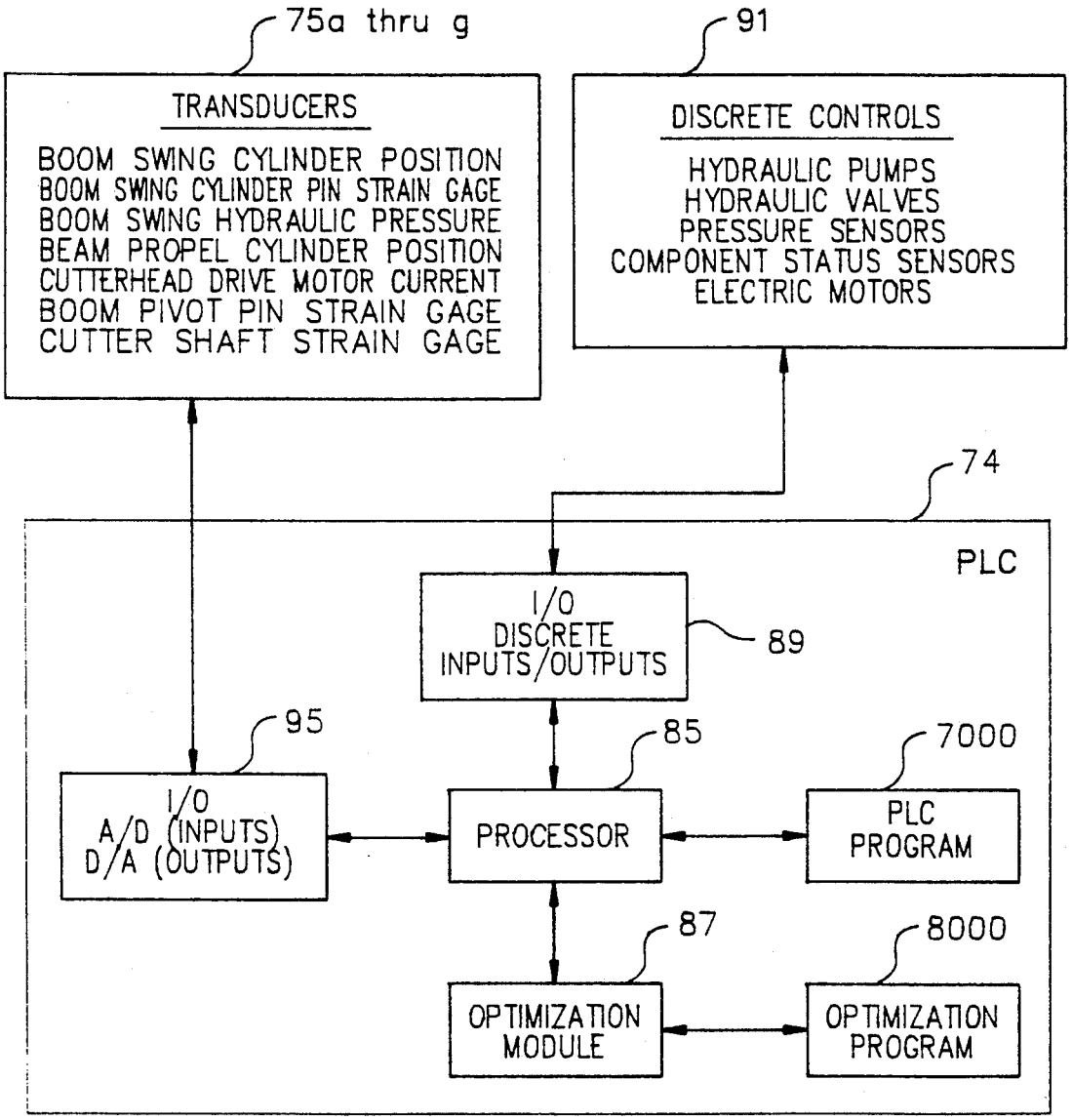

As illustrated in the diagram of FIG. 6, the PLC 74 may be programmed to continuously monitor the cutter wheel drive motor power using the output from the cutter wheel drive motor current transducer **75*f*, which provides a reasonably accurate measure of motor power input for a constant-voltage supply. The measured power level is compared with the maximum power level which may be safely utilized by the cutter wheel drive system. From the swing cylinder length transducers 75*a*, the PLC 74 can also determine the angular position and slew rate of the boom assembly 17. If the measured power level is significantly lower than the maximum power level and the slew rate is below the pre-determined maximum value, the PLC 74 may control a proportional control value controlling a swing pump feeding oil to the swing cylinders 54 to increase the slew rate. As the cutting wheel 36 rotates at a relatively constant speed in this embodiment, this has the effect of increasing the pitch of the spiral lines scribed in the rock (kerf spacing) by the cutting flanges 50 during successive rotations of the cutting wheel 36. This effect increases the force applied to the cutting flanges 50 by the rock and thus increases the power demand of the cutting wheel drive motors 37. The volume of rock cut from the face 76 also increases with increased kerf spacing, and thus the output of the mobile mining apparatus may be optimized for rock with particular cutting properties. Should the cutting wheel 36 encounter harder rock as it slews across the face 76, the power demand of the cutting wheel drive motors 37 will rise, and the PLC 74 will reduce the slew rate of the boom assembly 17 until the maximum sustainable production rate consistent with the cutting wheel power limit is again reached. This form of production optimization is particularly applicable to a cutting wheel in which all of the cutting flanges 50 are co-planar and thus scribe a single spiral line across the face 76, whereby all kerf spacings are dependent only on the slew rate of the boom assembly 17 relative to the rotational speed of the cutting wheel 36**.

The PLC 74 may also monitor the swing cylinder oil pressure through the boom swing hydraulic pressure sensors **75*e* to give a measure of the transverse loading on the cutting wheel 36, the boom pivot pin strain gauge 75*c* to give further information on both horizontal and vertical forces on the cutting wheel 36, and the cutter shaft strain gauges 75*g* (discussed below) to provide a measure of the direct load on one or more roller cutter assemblies 44. The computed forces are compared with predetermined limits, and the slew rate of the boom assembly 17 may be reduced below the optimum value for maximizing production to a value at which excessive stress levels are not generated on the cutters or within the structure of the mobile mining apparatus 17**.

If desired, the PLC 74 may be programmed to monitor changes in rock properties, such as rock hardness, relative to cutter wheel location across the face 76 using data including the cut spacing produced by the cutter power optimization algorithm. The rock hardness map so produced from one traverse of the cutting wheel may be utilized to program controlled variations in cut spacing for a succeeding traverse. Such a hardness map may also be used to detect a substantially vertical join between an ore body and surrounding rock of differing hardness, and may be utilized to control the extent of traverse of the cutting wheel to one side such that the ore body may be selectively mined.

The PLC 74 may be further programmed to monitor the cutting forces of individual cutters, such as by the use of strain transducers or the like, and the rotational position of the cutting wheel whereby the variation in rock properties along a cutter path line may be monitored and utilized for mapping the vertical variation in rock properties of the face 76. These transducers are cutter shaft strain gauges **75*g***, preferably Series 125 strain gauges manufactured by Micro-measurements of Raleigh, N.C.

It is readily apparent that the above description pertains to optimization of rock cutting by optimization of cutterhead plunge and cutterhead sweep. This optimization of cutterhead plunge and cutterhead sweep allows fine-tuning of machine performance in various rock conditions and maximizes penetration rate without exceeding either the cutterhead drive torque limit or the cutterhead bearings load capacity. In addition, control over both the cutter penetration and the cutter path spacing gives control of the average contract stress between the rock and the cutter edges, thus improving cutter ring life. This PLC 74 monitors machine performance and derives the optimum cutter penetration and cutter path spacing that will maximize performance.

Spacing between cutter paths is a function of the number of cutters in assemblies 44 and 45 on cutter wheel 36, the revolutions per minute of cutter wheel 36 and the slew rate. Thus, the spacing between cutter paths can be changed by varying the slew rate. Specifically, an increase in the slew rate causes a proportional increase in the spacing between cuts.

Direct control over the spacing between cuts allows the cutting performance to be optimized.

In soft rocks, for example, both a large plunge and fast swing rate can be used without over loading either the cutterhead power or cutter bearings. In hard rock, on the other hand, both the plunge and swing rate can be reduced to prevent high cutter loads and edge stresses.

Referring again to FIG. 6, PLC 74 includes a processor 85 which is preferably an Allen-Bradley Model PLC-5/25 Processor with 21K of memory. PLC 74 also has an optimization module 87, preferably an Allen-Bradley 1771 DB Basic Module.

PLC 74 also includes discrete input/outputs 89 which are preferably Allen-Bradley Model 1771-IMP, Model 1771-OMD, Model 1771-IBD and Model 1771 CBD, and which access discrete controls 91 such as hydraulic pumps, hydraulic values, pressure sensors, component status sensors, and electric motors known in the art. The A/D inputs and D/A outputs 95 of PLC 74 are preferably Allen-Bradley Model 1771-IFE and Model 1771-OFE, and access transducers 75*a*–75*g* discussed above. Processor 85 is connected to optimization module 87, discrete input/outputs 89, A/D inputs and D/A outputs 95, and is controlled by PLC program 7000 to be explained in further detail below. Optimization module 87 is controlled by optimization program 8000, discussed in detail below.

PLC 74, and specifically processor 85 in conjunction with PLC program 7000, controls the following functions of mobile mining apparatus 10: tramming from site to site, conditioning the face, overcutting the back for cutter replacement, unattended operation through one propel stroke, regrip at end of propel stroke, horizontal and vertical steering, curve development, fire detection and suppression, cutterhead boom swing angle, cutterhead boom swing rate, and cutterhead plunge depth.

Optimization module 87, in conjunction with optimization program 8000, analyzes machine data performance sent by processor 85. Specifically, processor 85 sends data based on cutterhead drive motor amperage, swing cylinder extension cutter loads and boom forces to optimization module 87.

From this data optimization module 87 will calculate the cutter penetration (plunge) and the spacing between cuts (swing rate) required to maximize machine performance in the rock being mined. In weal rocks, this will be the deepest plunge and highest slew rate that fully utilizes the available cutter wheel drive power without exceeding the maximum allowed slew angle (the angle between the cutter paths and the vertical). In hard rocks, limitations such as the bearing load capacity of the cutters are expected to restrict the penetration and slew rate, causing the machine to operate below the maximum cutter head power.

For optimization module 87 to send updated plunge depth and swing rate instructions to processor 85, optimization program 8000 uses equations that define the relationships between the cutter penetration and spacing between cuts, and the resulting cutter loads, edge stresses and cutterhead power. Such equations will allow the machine to respond quickly to changing rock conditions and, thus, will allow it to achieve maximum penetrations rates over most of the cutting time.

The machine performance data that will be used by the optimization program 8000 for calculating the maximum operating conditions include the cutterhead motor amperage, cutter normal force (optional), the plunge at the beginning of each slew, and the extension of the swing cylinders. During a slew the cutterhead motor amperage, cutter normal force, and the swing cylinder extensions will be sent to the optimization module 87 at fixed intervals (presently set at 5 degrees). The motor amperage will be used to calculate the cutterhead torque and the cylinder extensions will be used to calculate the slew angle and slew rate.

The average cutter normal force (Fn) for each 5 degree slew for example will be either calculated by the optimization module 87 from the average cutterhead torque and cutter penetration as determined from the plunge and slew angle or measured directly. Normal force calculations from the cutterhead torque will be done by calculating the average tangential force on the cutters (Ft-rolling force) from the cutterhead torque and the average cutter coefficient (Ft/Fn) based on the cutter penetration. By multiplying these two values, the cutter normal force (Fn) can be determined. The cutter edge loads (i.e. force per unit contact length between the cutter and rock) can also be determined either from the cutter rolling force and cutter penetration or from the measured cutter normal force.

After the average cutter normal force, cutter edge load and cutter head drive power are known, the cutter penetration and spacing between cuts (slewing rate) that will produce the maximum machine performance can be calculated using the relationships defined by the predictor equations. This will be done with the following limitations being observed: bearing capacity of the cutters, cutterhead power limit, cutter edge load limit, and slew angle limit.

The cutter edge load limit is used to protect the cutters from excessively high edge stresses that might occur in hard rock and cause catastrophic brittle failure. It also helps to reduce the cutter wear rates caused by small scale chipping at the cutter edges and high abrasion rates. The slew angle limit is used to protect the cutters from excessively high sides loads caused by slewing and protects the cutter rings from excessive abrasive wear due to cutter skidding.

In the first mode of operation (Mode 1), the optimization module 87 and optimization program 8000 will send a new plunge rate, plunge depth, and a new average slew rate to the processor 85 once at the end of each slew. All calculations for maximizing performance will usually be made during the time that the cutterhead is ramping down just prior to contact with the side wall of the tunnel, and the new plunge and slew rate value will be passed to the processor 85 usually just prior to the start of the next swing. In this mode, the slew rate of the cutterhead will not be varied during a swing unless some overload of the cutterhead power occurs causing the processor 85 to take corrective action by slowing the slew rate or, if the overload is extremely severe, shutting down the machine. Optimum plunge depth and plunge rate are derived for each entire slew and do not change unless overload occurs.

In a second mode of operation (Mode 2) optimization module 87 and optimization program 8000 will map the tunnel face using the input data, and from this map calculate a matrix of slew rate values as a function of the slew angle. This mode of operation is useful in mixed rock conditions where the cutter loads will vary across the face. Under such conditions, reducing the slew rate over the hard rock portions of the face helps to reduce these loads by reducing the spacing between cuts. Optimum plunge depth and plunge rate are derived for each entire slew and do not change during the slew unless overload occurs.

In Mode 3, optimization module 87 and optimization program 8000 make substantially real time corrections to the slew rate during a swing. This requires substantially continuous communication (such as at 5 degree increments) between optimization module 87 and processor 85. Optimum plunge depth and plunge rate are derived for each entire slew and do not change unless overload occurs.

It will, of course, be realized that while the above has been given by way of illustrative example of this invention, all such and other modifications and variations thereto as would be apparent to persons skilled in the art are deemed to fall within the broad scope and ambit of this invention as is herein set forth.

We claim:

1. A cutter wheel assembly including a cutting wheel having a peripheral wheel rim supporting a plurality of main wheel cutters having cutting rims and being disposed with their cutting rims vertical to the cutter wheel axis, said main wheel cutters being characterized in that said cutting rims are substantially within a single main cutting plane, and a plurality of gauge wheel cutters disposed on either side of the single plane of the cutting rims, said gauge wheel cutters being characterized in that the gauge axes about which said gauge wheel cutters rotate are substantially inclined to said main cutting plane.

2. A cutter wheel assembly as defined in claim 1, wherein said wheel rim is fully contained between a pair of opposed cones having a common base circle joining the portions of said cutting rims furthest from said cutter wheel axis, characterized in that the included angles at the apexes of said opposed cones are maximized, and are a minimum of one hundred and twenty degrees.

3. A cutter wheel assembly as claimed in claim 2, wherein said cutting wheel is supported on a boom assembly for slewing motion about a slewing pivot axis, said slewing pivot axis being substantially perpendicular to said cutter wheel axis and coplanar with said main cutting plane.

4. A cutter wheel as claimed in claim 1, wherein the spacing between a pair of planes perpendicular to said cutter wheel axis and enclosing the cutting portions of said gauge wheel cutters does not exceed one-sixth of the diameter of a circle joining the portions of said cutting rims furthest from said cutter wheel axis.

5. A cutter wheel assembly including a cutting wheel having a peripheral wheel rim supporting a plurality of main wheel cutters having cutting rims and being disposed with their cutting rims vertical to the cutter wheel axis, said main wheel cutters being characterized in that said cutting rims are substantially within a main cutting plane, and a plurality of gauge wheel cutters disposed on either side of the plane of the cutting rims, said gauge wheel cutters being characterized in that the gauge axes about which said gauge wheel cutters rotate are substantially inclined to said main cutting plane, said peripheral wheel rim being fully contained between a pair of opposed cones having a common base circle joining the portions of said cutting rims furthest from said cutter wheel axis, characterized in that the included angles at the apexes of said opposed cones are maximized, and are a minimum of one hundred and twenty degrees.

6. A cutter wheel as claimed in claim 5, wherein the spacing between a pair of planes perpendicular to said cutter wheel axis and enclosing the cutting portions of said gauge wheel cutters does not exceed one-sixth of the diameter of a circle joining the portions of said cutting rims furthest from said cutter wheel axis.

7. A cutter wheel assembly as claimed in claim 5, wherein said cutting wheel is supported on a boom assembly for slewing motion about a slewing pivot axis, said slewing pivot axis being substantially perpendicular to said cutter wheel axis and coplanar with said main cutting plane.

8. A cutter wheel assembly including a cutting wheel having a peripheral wheel rim supporting a plurality of main wheel cutters having cutting rims and being disposed with their cutting rims vertical to the cutter wheel axis, said main wheel cutters being characterized in that said cutting rims are substantially within a main cutting plane, and a plurality of gauge wheel cutters disposed on either side of the plane of the cutting rims, said gauge wheel cutters being characterized in that the gauge axes about which said gauge wheel cutters rotate are substantially inclined to said main cutting plane, the spacing between a pair of planes perpendicular to said cutter wheel axis and enclosing the cutting portions of said gauge wheel cutters not exceeding one-sixth of the diameter of a circle joining the portions of said cutting rims furthest from said cutter wheel axis.

9. A cutter wheel assembly as defined in claim 8, wherein said wheel rim is fully contained between a pair of opposed cones having a common base circle joining the portions of said cutting rims furthest from said cutter wheel axis, characterized in that the included angles at the apexes of said opposed cones are maximized, and are a minimum of one hundred and twenty degrees.

10. A cutter wheel assembly as claimed in claim 8, wherein said cutting wheel is supported on a boom assembly for slewing motion about a slewing pivot axis, said slewing pivot axis being substantially perpendicular to said cutter wheel axis and coplanar with said main cutting plane.

* * * * *